US005486012A

United States Patent [19]

Olivieri

[11] Patent Number: 5,486,012

[45] Date of Patent: Jan. 23, 1996

[54] BRAKING SYSTEM FOR IN-LINE SKATES

[75] Inventor: Icaro Olivieri, Westmount, Canada

[73] Assignee: Canstar Sports Group Inc., Quebec, Canada

[21] Appl. No.: 260,374

[22] Filed: Jun. 14, 1994

[51] Int. Cl.[6] ..... A63C 17/14

[52] U.S. Cl. ..... 280/11.2; 280/11.22

[58] Field of Search ..... 280/11.2, 11.19, 280/11.22, 11.23, 11.27, 11.28, 87.042; 188/5, 6, 7

[56] References Cited

U.S. PATENT DOCUMENTS

| | | | |
|---|---|---|---|
| 5,088,748 | 2/1992 | Koselka et al. | 280/11.2 |
| 5,330,207 | 7/1994 | Mitchell | 280/11.2 |
| 5,397,137 | 3/1995 | Pellegrini, Jr. et al. | 280/11.2 |
| 5,435,579 | 7/1995 | Pazzbon | 280/11.2 |

*Primary Examiner*—Richard M. Camby

*Attorney, Agent, or Firm*—R. Craig Armstrong

[57] ABSTRACT

A braking system for an in-line skate, where a linkage assembly connects a rotatable boot cuff to a brake assembly which pivots between a retracted position braking position. The linkage assembly includes a drive arm, a transfer bracket and a short connector link. The transfer bracket has three pivot points which are arranged such that the mechanical advantage provided by the transfer bracket in translating downward movement of the drive arm to downward movement of the connector link and brake assembly is less than one in the retracted position, and increases as the cuff is rotated rearwardly to move the drive arm downwardly and the brake assembly towards the ground. Preferably, the connector link rotates over center to a locked position once the brake is in contact with the ground and the cuff is rotated slightly rearwardly. The distance between the cuff and the brake assembly is adjustable so that the desired adjustment of the linkage assembly and braking system can be maintained as the brake pad wears down.

9 Claims, 9 Drawing Sheets

BRAKING SYSTEM FOR IN-LINE SKATES

BACKGROUND OF THE INVENTION

This invention relates to in-line skates, and specifically to a braking system for same. The invention could also be readily adapted to conventional roller skates, if desired.

In-line skating has become very popular as a sport and recreational activity. Associated sports such as in-line hockey and competitive in-line racing have transformed in-line skating from a casual hobby into a rigorous sporting event. This transformation has increased the need for high-performance in-line skates.

For skaters at all levels of expertise, there is a particular need for improved braking systems. By far the most common braking arrangement today is a heel brake, i.e. a brake pad mounted off the back of one or both skates. The skater brings the brake pad into contact with the ground by raising the toe of the skate to rotate it about the rear wheel and pressing down at the heel. Other known but less common braking arrangements involve using brake shoes to bring brake pads directly into contact with one or more wheels, or using the equivalent of an automotive disc brake, i.e. bringing a brake pad into contact with another element which is connected to the wheel (as in an automotive disc brake). See U.S. Pat No. 5,232,231 (Carlsmith) for an excellent general review of the prior art.

Most braking systems are actuated by changing the orientation of the whole boot, as is the case with heel brakes. However, other actuation means are known. For example, many patents involve the use of hand-actuated brake controls which lead to various braking means via cables which run down one or both legs of the skater. Examples are U.S. Pat. Nos. 182,835 (Lockwood), 1,801,205 (Mirick), 2,027,487 (Means), 2,140,955 (Goettie), 4,943,075 (Gates), 5,171,032 (Dettmer), 5,226,673 (Cech), and 5,251,934 (Gates).

Such cable arrangements achieve a highly desirable object, namely to permit braking while enabling the skater to keep all wheels still on the ground. However, in practice they are fundamentally impractical, since either the brake is not instantaneously available, or the skater has to have a brake control held in his or her hand, which restricts freedom of movement, interferes with balance, and increases the possibility of injury during the inevitable falls.

It would be highly advantageous to have a braking system which permitted braking with all wheels still essentially on the ground, but which did not require hand controls. Several rather old patents show early attempts to achieve this, but they were ineffective and impractical by today's standards. For example, U.S. Pat. Nos. 920,848 (Eubank), 1,402,010 (Ormiston) and 1,497,224 (Ormiston) all show straps which are adapted to buckle about the ankle of the skater, and which are connected to actuate the brake when the ankle is rotated forwardly (Eubank) or rearwardly (both Ormiston patents) relative to the skate.

It follows that there is a need for a braking system which permits braking with all wheels remaining on the ground, but which does not require hand controls. At the same time, the system must readily lend itself to present in-line skates designs without major modifications to the overall structure, and must deliver sufficient braking force for adequate speed control.

A recent development is Rollerblade's ABT ("active braking technology") system, in which rearward rotation of the cuff of the boot forces an assembly downwardly, the downward movement pressing a pivotally-mounted brake pad against the ground. However, this system involves essentially a direct linkage between the cuff and the brake, i.e. with no variation in mechanical advantage as the brake position changes.

SUMMARY OF THE INVENTION

In the present invention, it was realized that it would be advantageous to provide a braking system activated by rotation of the cuff, where a linkage was employed which would provide a varying mechanical advantage as the brake position changed. It was realized that it would be desirable to have a mechanical advantage of considerably less then one initially, such that a small initial movement of the cuff would produce a larger movement of the brake to bring it quickly down towards the ground while no substantial force is required, and to then have the mechanical advantage increase, preferably to greater than one, as braking force is applied.

It is an object of the invention to provide such an improved braking system, which could permit effective braking with all wheels remaining on the ground, but which does not require hand controls.

It is a further object of the invention to provide a system which could permit locking of the brake in the "on" position, so that full-force braking could be continued by direct application of the skater's weight, without further application of force to rotation of the cuff.

Accordingly, the invention provides a linkage arrangement, connected between the cuff and a pivotable brake assembly with a brake pad, the linkage being configured to provide a mechanical advantage of less than one during initial rearward rotation of the cuff, and an increased mechanical advantage as the rotation continues and brings the brake into contact with the ground.

Preferably, the linkage is further configured such that one of the linkage elements moves to an "over center" position at the limit of rearward rotation of the cuff, against a stop, the over center position serving to lock the linkage in a full braking position, such that no additional force need be applied to the cuff to maintain braking, and such that the braking can be unlocked only by forward rotation of the cuff.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION

Figure 1:
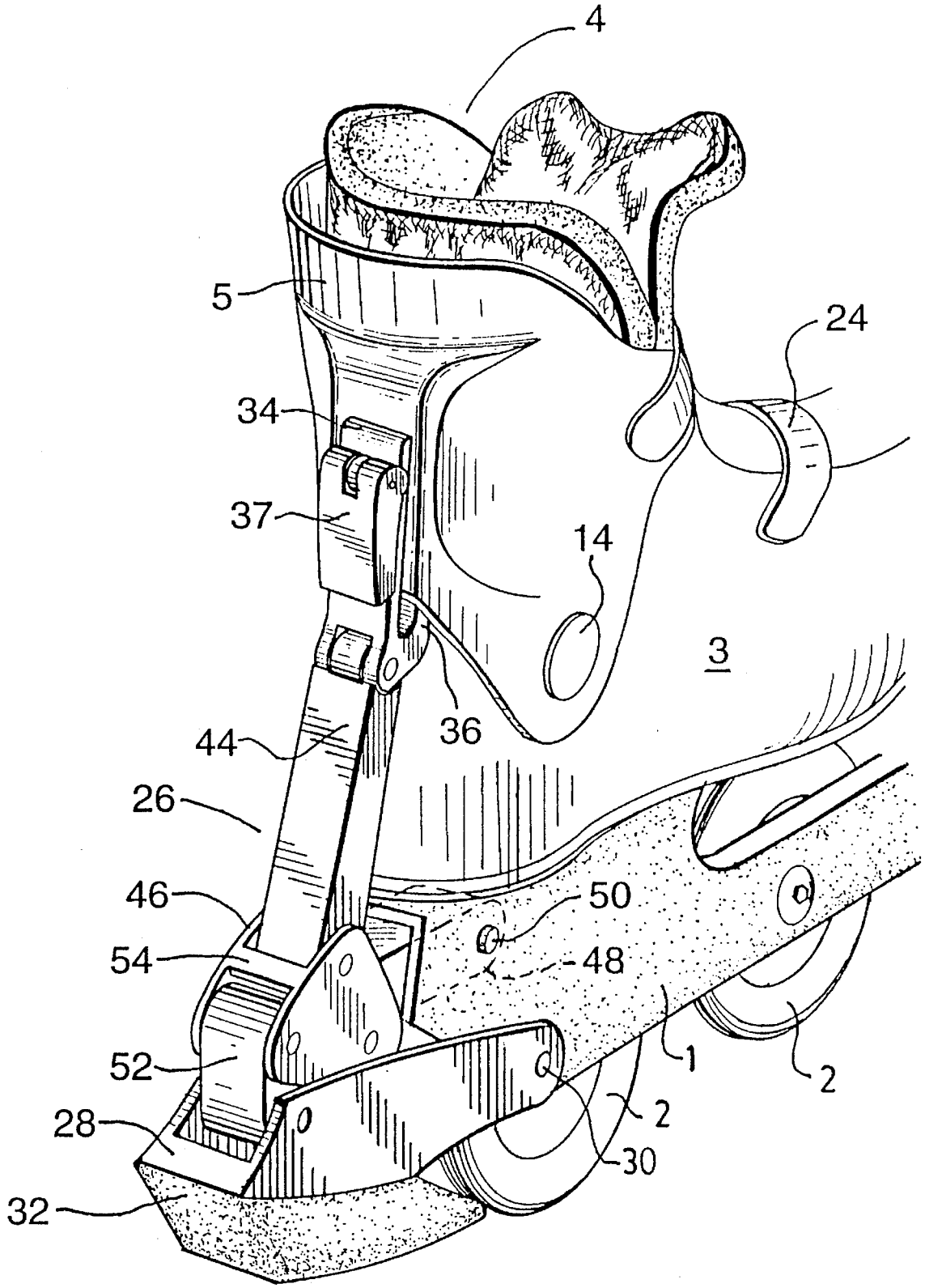
FIG. 1 is a perspective view of the rear of the skate.
Figure 4:
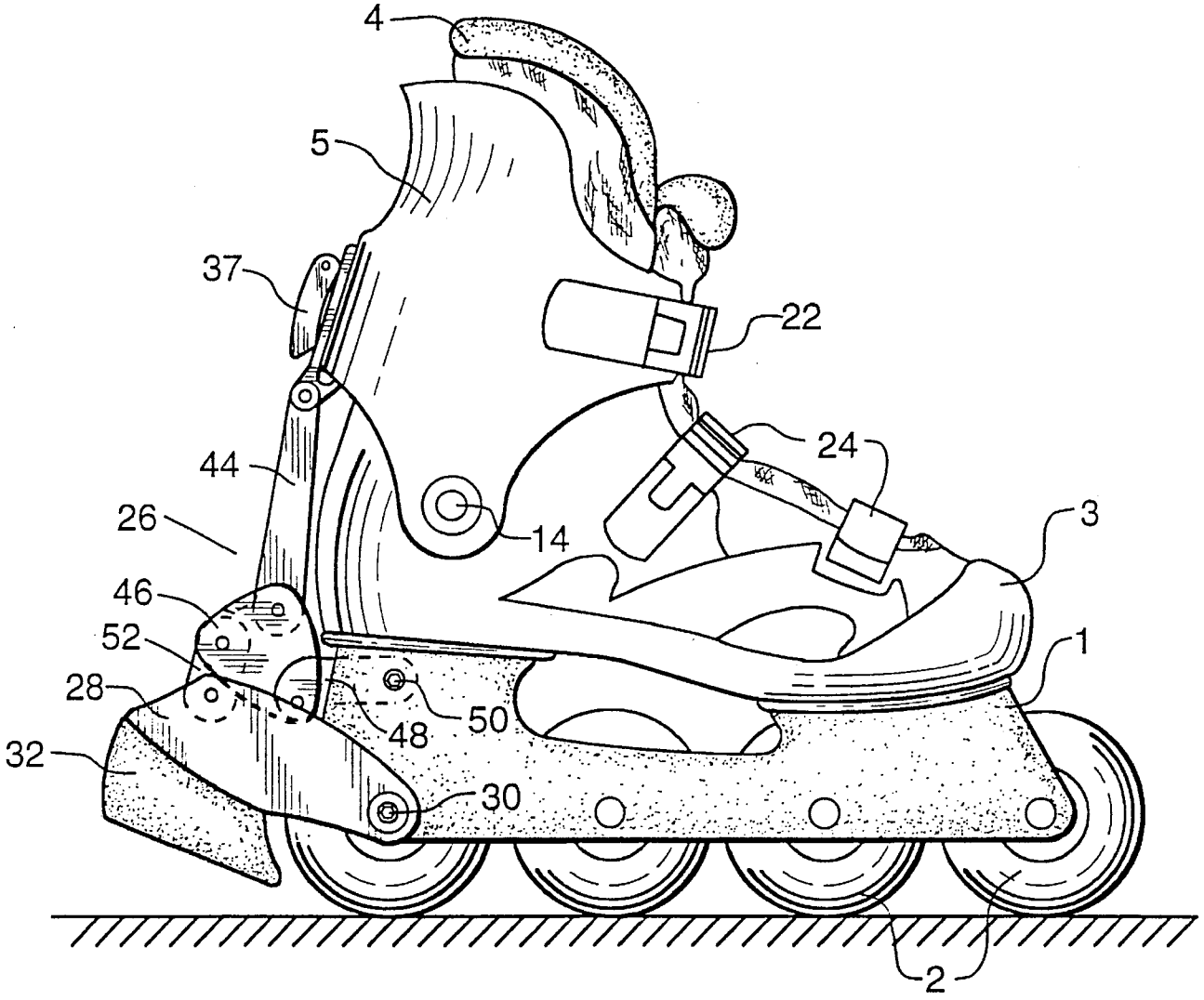
FIG. 4 is a side view of the skate, with the brake pad in the normal, retracted position.
Figure 5:
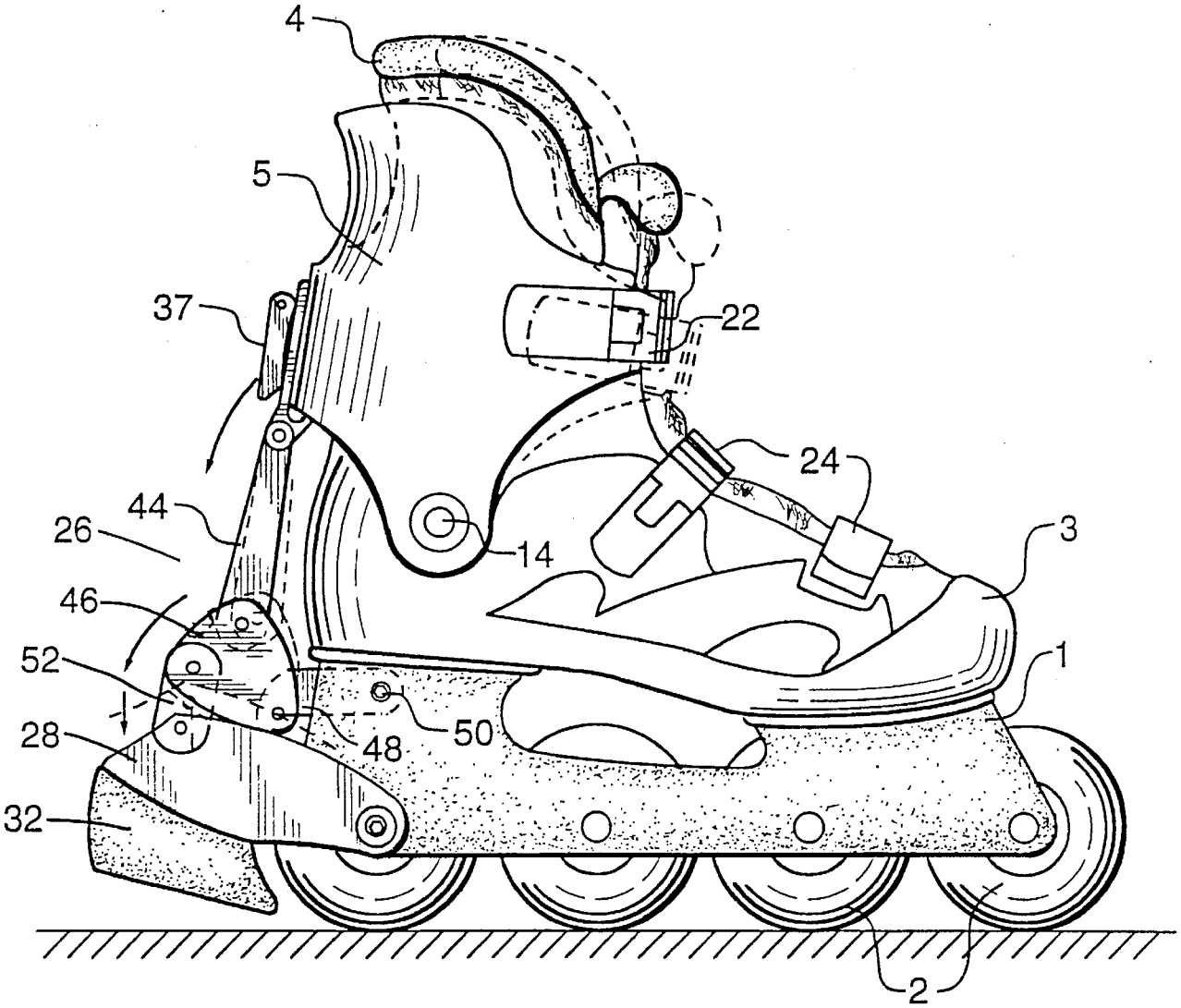
FIG. 5 is a side view similar to FIG. 4, but showing the cuff rotated partially rearwardly and the brake pad thus being partially extended towards the ground.
Figure 6:
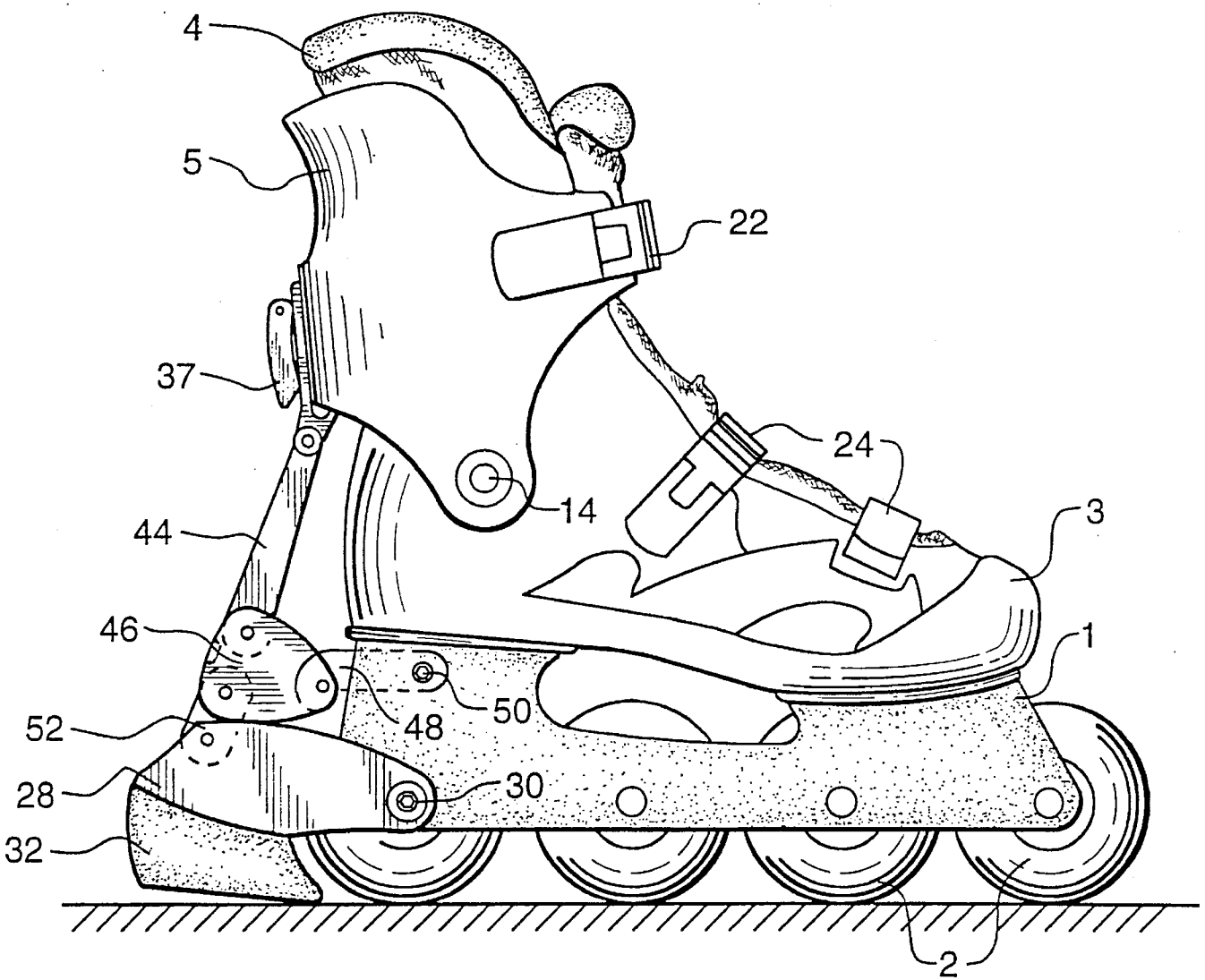
FIG. 6 is a side view similar to FIGS. 4 and 5, but showing the cuff rotated rearwardly such that the brake pad is contacting the ground.

Referring to FIGS. 1 and 4 primarily, the main components of the skate itself are: a chassis 1, which carries a plurality of wheels 2; a boot 3; a liner 4; and a cuff 5.

The liner 4 is a generally conventional flexible padded sock-like structure. The liner fits within the boot 3.

The cuff 5 is pivotally connected to the boot, or to upward extensions of the chassis, at pivot points 14. The pivot points are on lateral and medial sides of the skate, preferably in alignment with the user's malleoli, to permit dorsal/plantar flexion with minimal resistance.

Suitable straps are used to tighten the skate onto the user's foot, such as a cuff strap 22, and boot straps 24.

The above structures are conventional.

Figure 2:
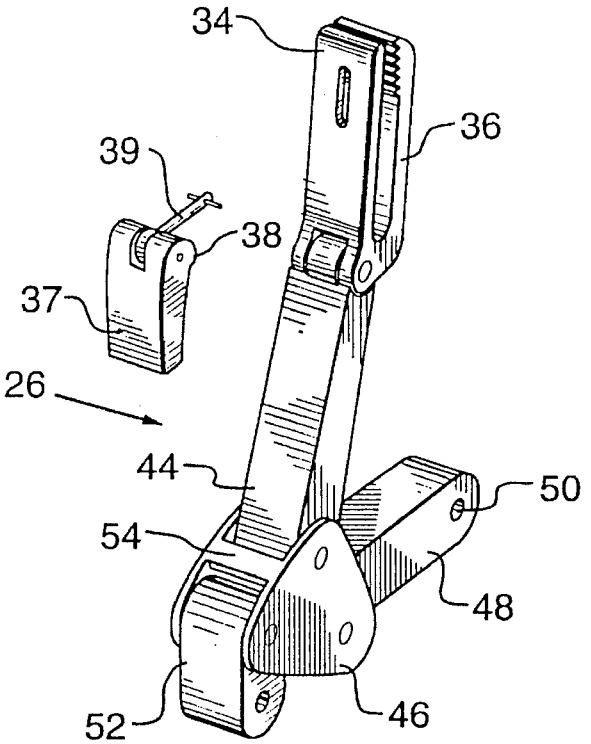
FIG. 2 is a perspective view of the brake actuating linkage.

In the invention, as seen clearly in FIGS. 1 and 2, a linkage assembly 26 is connected at its upper end to the cuff 5, and at its lower end to a rotatable brake assembly 28, which pivots about a pivot point 30 and carries a replaceable brake pad 32.

Figure 7:
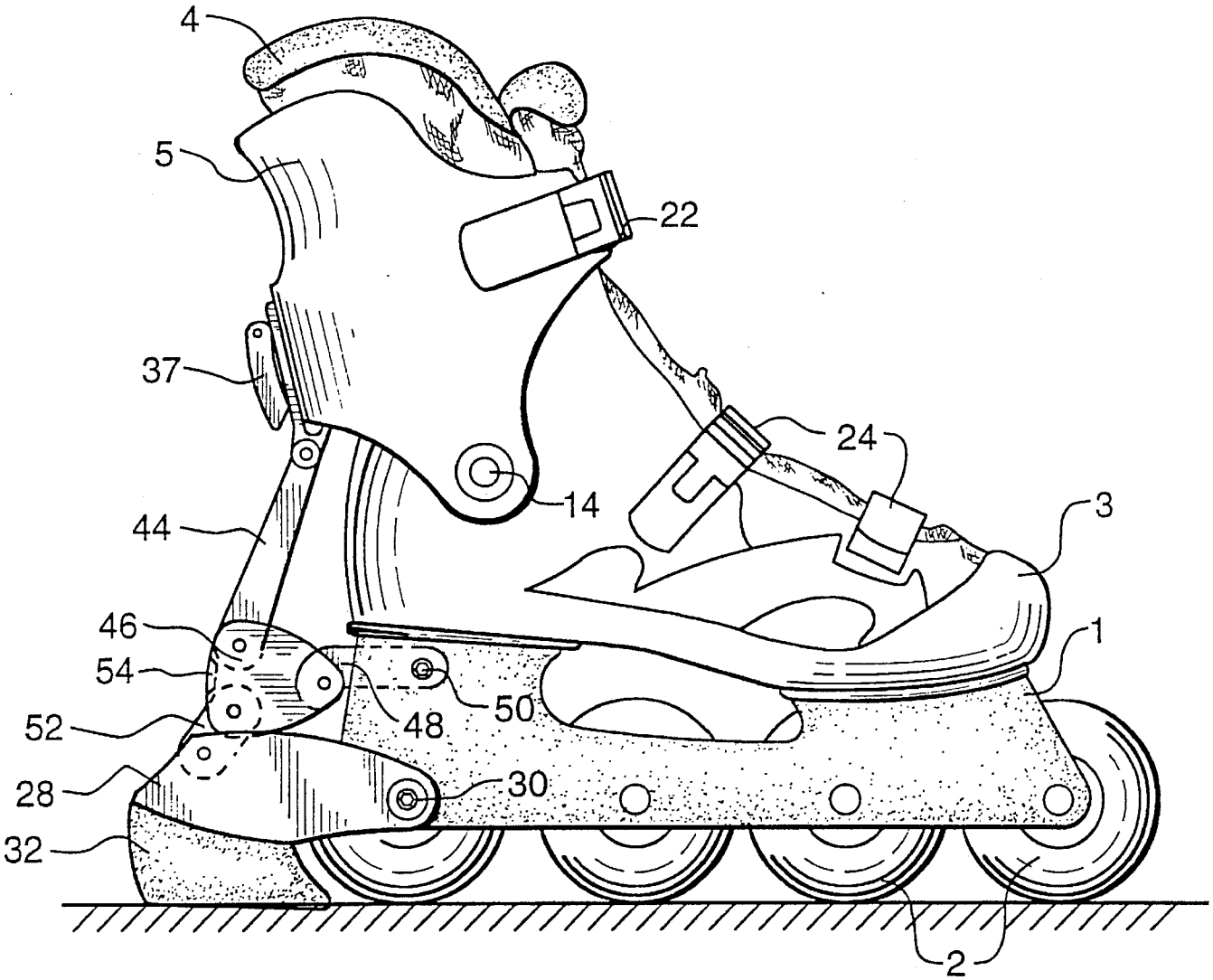
FIG. 7 is a site view similar to FIGS. 4, 5 and 6, but showing the cuff fully rotated rearwardly and the brake pad in the fully extended and locked position.

As can be readily seen from FIGS. 1, 4, 5 and 6 in particular, rotating the cuff 5 rearwardly causes the linkage assembly to rotate the brake assembly downwardly, bringing the brake pad into contact with the ground. Further rotation, as shown in FIG. 7, produces sufficient rotation of the linkage to "lock" it in place against a stop, as will be explained in greater detail below. Depending on the skater's preference, skill level, and need to brake quickly, the brakes on either or both skates could be actuated at any given time (assuming that both skates are equipped with the braking mechanism).

Figure 3:
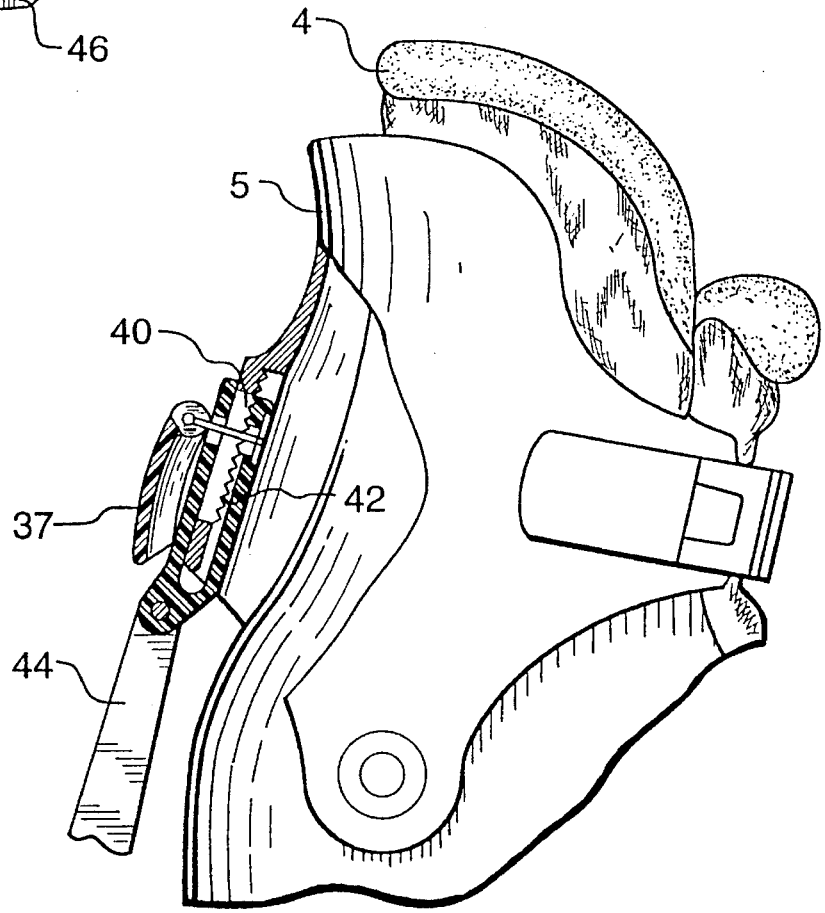
FIG. 3 is a side cross-sectional view showing the attachment of the linkage to the cuff of the boot.

From top to bottom, the linkage assembly 26 starts with an attachment fork, including and outer arm 34 and an inner arm 36, which are used to clamp the upper end of the linkage assembly to the cuff, via a lever arm 37 embodying a cam 38 to pull a tee 39 so as to pull the inner arm and outer arm towards each other. The cuff has a slotted hole 40 to provide means for moving the fork up and down relative to the cuff in order to adjust the brake position, to maintain optimum braking despite wear on the brake pad. The back face of the cuff has serrations 42 for engaging corresponding serrations on the rear of the inner arm (see FIGS. 2 and 3) to prevent slippage when braking pressure is applied.

Pivotally connected to the attachment arm 34, and extending downwardly from the lower end thereof, is a drive arm 44. The lower end of the drive arm is in turn pivotally connected to the upper portion of a transfer bracket 46.

The transfer bracket 46 is pivotally connected at a forward pivot point to a rigid support arm 48 which extends rearwardly out a slot in the chassis 1, and which is held in place by a pin 50. The transfer bracket is also connected, at a rearward pivot point, to a pivot point on the brake assembly 28, via a short connector link 52.

A particular advantage of the invention is that when one wants to "put on the brakes" to slow down, putting one foot forward is a natural reaction, which is precisely what will put the brakes on, via rearward rotation of the cuff relative to the boot. The farther the foot is put forward and the more the cuff is rotated rearwardly, take greater the braking power, which again is highly desirable. The result is very natural or "intuitive" braking.

Also, because of the unique configuration of the linkage in the invention, the principles of mechanical advantage are applied to produce optimum braking characteristics, as will now be explained. For convenience, the various linkage points will be designated as A, B, C, D and E, where A is the pivot point between the attachment fork 34 and the drive arm 44, B is the pivot point between the lower end of the drive arm and the upper portion of the transfer bracket 46, C is the pivot point between the transfer bracket and the rigid support arm 48, D is the pivot point between the transfer bracket and the short connector link 52, and E is the pivot point between the connector link and the brake assembly 28.

Figure 8:
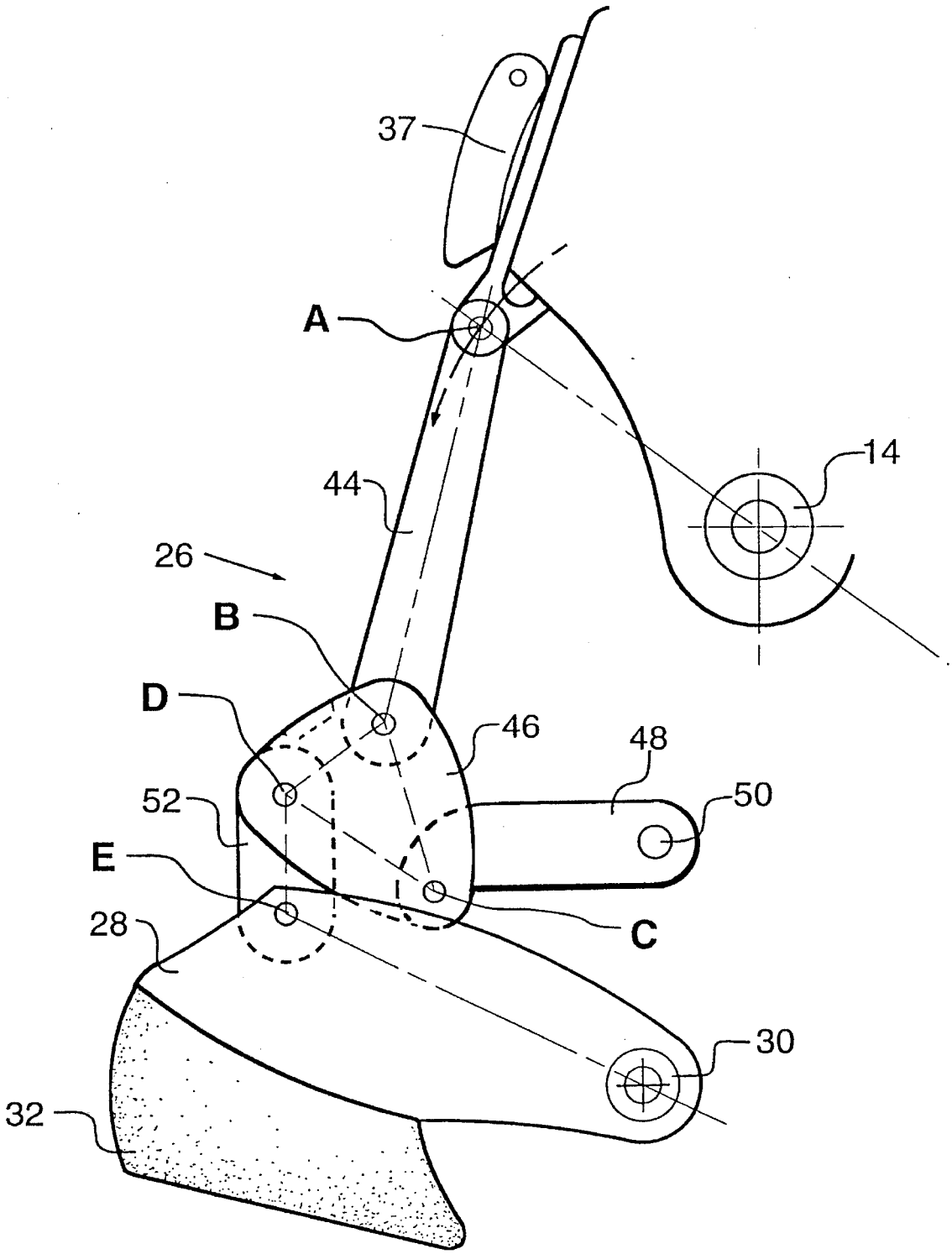
FIG. 8 is a schematic side view of the linkage in the normal or retracted position.
Figure 9:
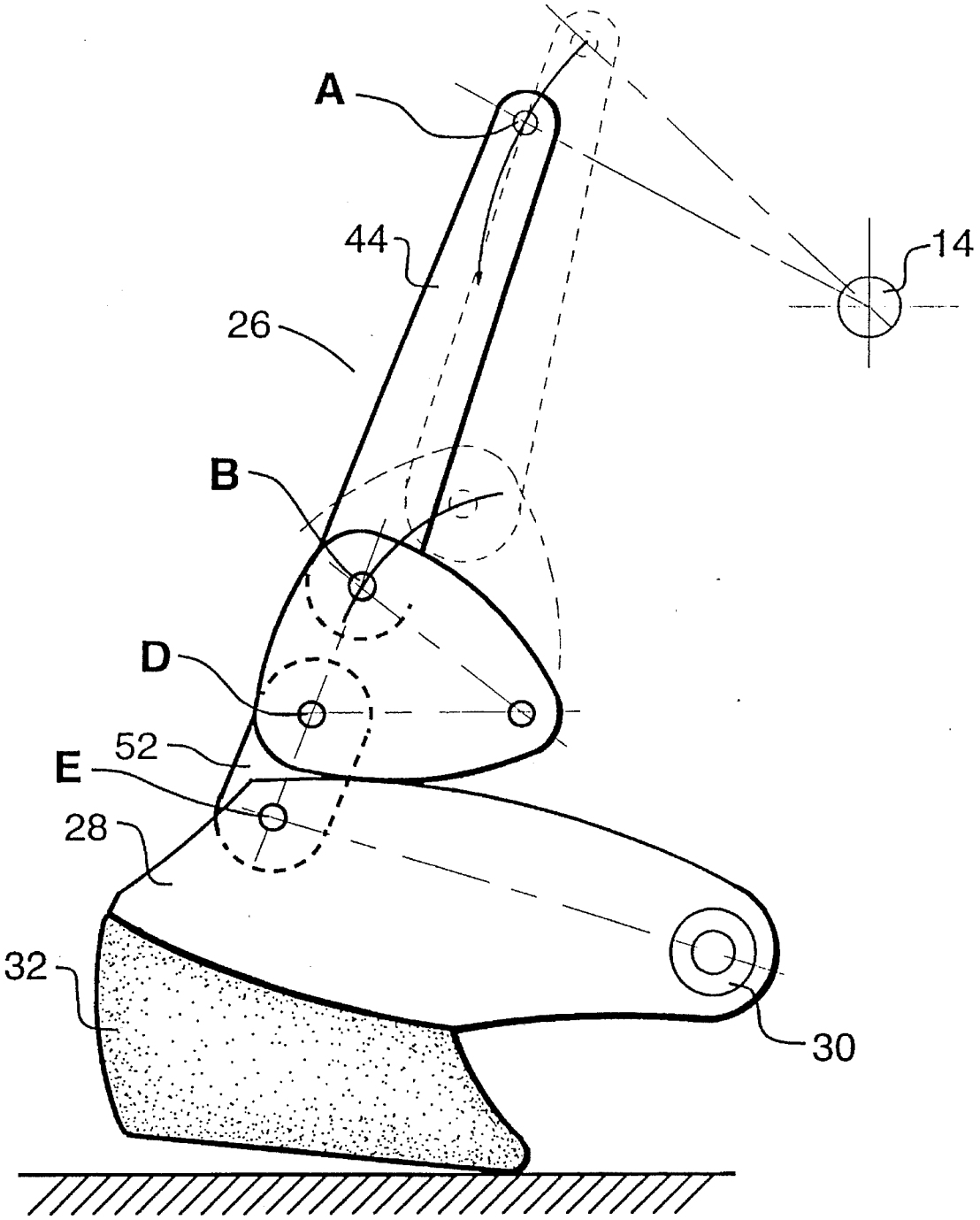
FIG. 9 is a schematic side view similar to FIG. 8, but showing the linkage in the partially extended position.
Figure 10:
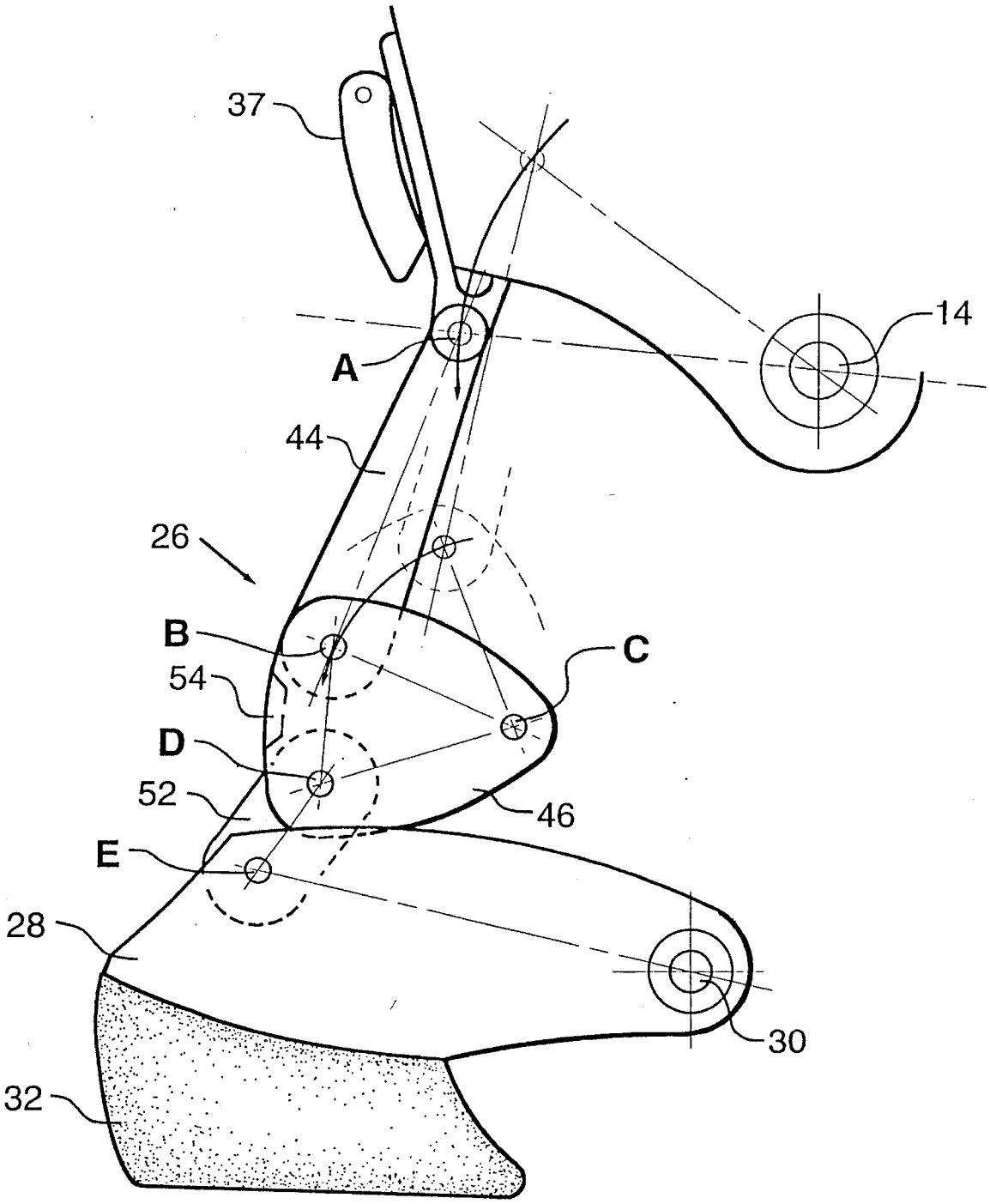
FIG. 10 is a schematic side view similar to FIGS. 8 and 9, but showing the linkage in the fully extended and locked position.

The sequence of braking action is shown most clearly in FIGS. 4–7, and then in FIGS. 8–10. In FIG. 8, representing the position of the linkage and brake in the normal or "brakes off" position, it can be readily seen that the mechanical advantage provided by the transfer bracket 46 is substantially less than one. That is because the line of the force applied through pivot point B, i.e. a line from B at ninety degrees to a line connecting points C and D, is between points C and D, so that the transfer bracket acts as a second class lever, to move the brake downwardly more rapidly while little force is required.

In FIG. 9, as the brake is coming into contact with the ground or about to do so, the transfer bracket has rotated to a position where the mechanical advantage is approaching one.

In FIG. 10, two things should be noted. First of all, it can be seen that in moving towards the FIG. 10 position, the mechanical advantage of the transfer bracket has increased to greater than one, thereby multiplying the force through the linkage, with the linkage acting as a third class lever.

Secondly, it can be seen that the connector link 52 has rotated "over center" such that pivot point D has passed the line between pivot points C and E. A stop 54 inside the transfer bracket prevents further rotation. At that point, the brake is in effect locked on, so that full braking force can be applied by the skater's weight. Forward rotation of the cuff, when braking is no longer required, unlocks the brake.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, it should be appreciated that the principle of the invention resides in the linkage which increases the mechanical advantage at progressing points in the braking cycle. The invention is not restricted to a particular range of mechanical advantages. It is sufficient that the mechanical advantage increases substantially as the braking action progresses, so that the emphasis initially is on moving the brake into contact with the ground, and then is on maximizing the force which can be applied.

I claim:

1. A braking system for an in-line skate for a skater, where said skate comprises a boot/chassis assembly including a chassis carrying a plurality of in-line wheels to run on the ground, and a boot mounted above the chassis, said boot/chassis assembly including a plastic cuff securable around the skater's ankle and pivotally connected to said boot/chassis assembly at pivot points generally in the area of the skater's malleoli, said braking system comprising a linkage assembly connected at an upper end thereof to a rear portion of said cuff, and at a lower end thereof to a rotatable brake assembly, which brake assembly pivots about a pivot point mounted on said chassis and carries a replaceable brake pad, said brake assembly pivoting between a retracted position where said brake pad is above the ground, and a braking position where said brake pad is in contact with the ground, said linkage assembly comprising a drive arm, a transfer bracket and a short connector link;

said drive arm having an upper end and a lower end, said upper end being secured to the back of the cuff, to move upwardly and downwardly with rotation of the cuff;

said transfer bracket having three pivot points B, C, and D, where B is a pivotal connection between the lower end of said drive arm and an upper portion of said transfer bracket, C is a pivotal connection between a forward portion of said transfer bracket and support means rigidly positioned with respect to said boot/chassis assembly and extending rearwardly therefrom, and D is a pivotal connection between a rearward portion of said transfer bracket and an upper end of said short connector link;

said short connector link having an upper end and a lower end, said lower end being pivotally connected at a pivot point E to said brake assembly;

said pivot points B, C and D being arranged such that the mechanical advantage provided by said transfer bracket in translating downward movement of said drive arm to downward movement of said connector link and brake assembly is less than one in said retracted position, and increases as said cuff is rotated rearwardly to move said drive arm downwardly and said brake assembly towards the ground.

2. A braking system as recited in claim 1, where said linkage assembly is arranged such that pivot points B, D and E come into general alignment with each other as the brake pad comes into contact with the ground.

3. A braking system as recited in claim 2, where said linkage assembly is arranged such that after pivot points B, D and E come into general alignment with each other as the brake pad comes into contact with the ground, slight further downward movement of said drive arm by slight further rotation of said cuff causes said connector link to rotate such that pivot point D becomes positioned forwardly of an imaginary line connecting pivot points B and E, said connector link than coming to rest against a stop provided inside said transfer bracket, thus preventing further rotation, and thereby locking the brake "on", such that full braking force can be applied by the skater's weight.

4. A braking system as recited in claim 1, further comprising adjustment means for adjusting the distance between said cuff and said transfer bracket, whereby desired adjustment of said linkage assembly and braking system can be maintained as the brake pad wears down.

5. A braking system as recited in claim 4, where said adjustment means is by virtue of said drive arm being securable to said cuff at a variable position relative to said cuff.

6. A braking system as recited in claim 2, further comprising adjustment means for adjusting the distance between said cuff and said transfer bracket, whereby desired adjustment of said linkage assembly and braking system can be maintained as the brake pad wears down.

7. A braking system as recited in claim 6, where said adjustment means is by virtue of said drive arm being securable to said cuff at a variable position relative to said cuff.

8. A braking system as recited in claim 3, further comprising adjustment means for adjusting the distance between said cuff and said transfer bracket, whereby desired adjustment of said linkage assembly and braking system can be maintained as the brake pad wears down.

9. A braking system as recited in claim 8, where said adjustment means is by virtue of said drive arm being securable to said cuff at a variable position relative to said cuff.

* * * * *